US008313880B2

(12) United States Patent
Ashley et al.

(10) Patent No.: US 8,313,880 B2
(45) Date of Patent: Nov. 20, 2012

(54) MAGENTA TONER WITH BINDER RESIN OF SELECTED MOLECULAR WEIGHT COMPOSITION

(75) Inventors: Danielle Renee Ashley, Longmont, CO (US); James Robert Combes, Boulder, CO (US); John Joseph Earley, Boulder, CO (US); Lale Gokbudak Lovell, Longmont, CO (US); George Pharris Marshall, Denver, CO (US); Walter Mychajlowskij, Superior, CO (US)

(73) Assignee: Lexmark International, Inc., Lexington, KY (US)

( * ) Notice: Subject to any disclaimer, the term of this patent is extended or adjusted under 35 U.S.C. 154(b) by 610 days.

(21) Appl. No.: 12/540,577

(22) Filed: Aug. 13, 2009

(65) Prior Publication Data

US 2011/0039198 A1 Feb. 17, 2011

(51) Int. Cl.
*G03G 9/087* (2006.01)

(52) U.S. Cl. ..... 430/109.3; 430/109.1; 430/111.4; 430/137.1

(58) Field of Classification Search ..... 430/111.4, 430/109.1, 109.3, 137.1
See application file for complete search history.

(56) References Cited

U.S. PATENT DOCUMENTS 5,256,512 A * 10/1993 Kobayashi et al. ..... 430/109.4
5,912,099 A * 6/1999 Kanbayashi et al. .... 430/108.21
6,322,946 B1 * 11/2001 Mahabadi et al. ..... 430/137.12
6,531,254 B1 3/2003 Bedells
6,531,256 B1 3/2003 Bedells
7,288,351 B2 10/2007 Yaguchi
7,378,209 B2 5/2008 Suwa
7,386,264 B2 6/2008 Blair
7,435,523 B2 10/2008 Olson
2002/0037466 A1 * 3/2002 Kanbayashi et al. .... 430/108.23
2003/0152858 A1 * 8/2003 Osan et al. ..... 430/109.3
2004/0013958 A1 * 1/2004 Ayaki et al. ..... 430/45
2004/0142262 A1 * 7/2004 Nakamura et al. ..... 430/107.1
2005/0008960 A1 * 1/2005 Yaguchi et al. ..... 430/108.1
2005/0014079 A1 * 1/2005 Itakura et al. ..... 430/45
2005/0106481 A1 * 5/2005 Ayaki et al. ..... 430/45
2005/0106487 A1 * 5/2005 Harada et al. ..... 430/108.1
2006/0068306 A1 * 3/2006 Shu et al. ..... 430/45
2007/0184372 A1 * 8/2007 Itakura et al. ..... 430/45.4
2008/0220362 A1 9/2008 Moore
2011/0151373 A1 * 6/2011 Ayaki et al. ..... 430/124.1

OTHER PUBLICATIONS

Shimadzu Flowtester CFT-500D/100D Capillary Rheometers brochure.

* cited by examiner

*Primary Examiner* — Christopher Rodee

(57) ABSTRACT

The present disclosure relates to a magenta toner formulation that may be used in a toner printer cartridge for an electrophotographic printer. The magenta toner may include polymer resin binder containing three polymer resins with different number average molecular weight values. The concentration of such polymer resins may be selected to provide a desired temperature versus viscosity behavior for the magenta toner that may be configured to conform to the viscosity versus temperature provide for yellow, cyan and black toner.

11 Claims, 3 Drawing Sheets

MAGENTA TONER WITH BINDER RESIN OF SELECTED MOLECULAR WEIGHT COMPOSITION

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to toner used in toner cartridges, and in particular, to techniques for improving the fusibility of a magenta color toner.

2. Description of the Related Art

Instant-on fusers have become an essential element of the competitive color printer, nearly independent of the market niche or printer speed. Due to their low thermal mass and compact size, belt fusers may comprise one way to achieve this feature in a small-footprint printer. The fuser may be comprised of a flexible belt with a low thermal mass which passes over the surface of a heating element. There may be a back up member of some design which permits the heated surface to contact the powder image to be fused. Such a thermal belt fuser may be quite different from the extremes of thermal fusing methods, in that the shear rate applied, or pressure involved, in fusing may be minimal.

In the case of radiant fusing at one extreme, there may be no contact between the heat source and an unfused powder image, and as such there may be essentially a zero shear rate involved, which means that in order for the toner to flow and melt and adhere to the substrate, it must be heated sufficiently such that the viscosity may be reduced to a level to permit irreversible viscous flow. The other fusing extreme may involve the heating of a powder image while it is simultaneously subjected to pressure, and thus the irreversible viscous flow of the polymer melt may be possible at a much lower temperature than in the absence of pressure. At high pressures, polymer flow may be readily achieved at much lower temperatures than if no pressure is applied.

The belt fuser is a case where there is a finite pressure applied during the fusing event, but a minimal amount. Thus, the temperature must be high enough to reduce polymer viscosity at low applied pressures, or low shear rates. This polymer property associated with toner fusing under conditions of low shear may be referred to as 'low shear viscosity' or 'Non-Newtonian' viscosity. At such low shear rates, polymer chain entanglement may inhibit free viscous flow. As shear rate or applied pressure increases, polymer viscosity may decrease and fusing may be facilitated at any given temperature by the higher shear rate.

Toners for electrophotographic printers may be made by a conventional process involving a melt mix of resin(s), wax (es), pigment(s), and other additives. This material may then be subjected to a grinding process, which produces toner particles of roughly 10 microns. Smaller sizes can be achieved through this method, however limitations exist. The chemically produced toner (CPT) process may be performed by emulsion aggregation, suspension, or chemical milling. Chemically producing toner allows a smaller particle size toner to be produced that has tighter control of the particle shape and the particle size distribution. Fusing of a toner powder essentially comprises the melting and viscous flow of a filled polymer or filled polymer blend.

Toners are mainly made of binder (polymeric) resins and coloring agents, to which other materials are added including waxes that improve low-temperature fusing property onto a recording sheet and releasing property from the fusing member, charge control agents that add polarity (positive or negative electric charge), etc. Mainstream toner binder resins include styrene-acrylate resins and polyester resins.

The current state of the fusibility of toners is a process whereby both toner properties and fuser design may have to be modified to attain the desired performance of the toner on the substrate. Of the four colors, cyan, yellow, black and magenta, magenta has traditionally been relatively difficult color to fuse and to release from the fusing member. For that reason, 100% magenta image targets have been used as the fuser benchmark for determining acceptable performance. If the magenta solid image is considered to fuse, all other colors and combinations thereof will fuse. Few images are composed of 100% magenta toner, so perhaps it could be argued that this is too severe a test. Perhaps equally important, magenta is generally the uppermost (top) color in the layered color image. This means that upon fusing, magenta may be the color which contacts and releases from the fusing member, and may be the more difficult to fuse.

Improvements in the fusibility of magenta toner may therefore translate into improvements in the fusibility of full color imagery in electrophotographic devices.

SUMMARY OF THE INVENTION

Disclosed herein is a magenta toner for developing electrostatic images which comprises a binder resin and a colorant containing: (a) 85.0-87.0% of a polymer resin having a Mn value of 15,000 to 25,000; (b) 5.0-6.5% of a polymer resin having a Mn value of 400,000 to 600,000; and (c) 6.5-10.0% of a polymer resin having a Mn value of 950,000-1,500,000. The magenta toner powder so obtained may be characterized as having L*=41.07 (sd=0.424), a*=57.84 (sd=0.54) and b*=0.58 (sd=0.26) when measured on a mixture of magenta powder and 0.2% silica. The term "sd" refers to standard deviation.

The present disclosure also relates to magenta toner for developing electrostatic images which comprises a binder resin and a colorant containing:

85.0-87.0% of a polymer resin having a Mn value of 15,000 to 25,000;

5.0-6.5% of a polymer resin having a Mn value of 400,000 to 600,000;

6.5-10.0% of a polymer resin having a Mn value of 950,000-1,500,000.

The magenta toner powder so obtained may be characterized as having L*=41.07 (sd=0.424), a*=57.84 (sd=0.54) and b*=0.58 (sd=0.26) when measured on a mixture of magenta powder and 0.2% silica. In addition, such magenta toner may be positioned in a toner cartridge or an electrophotographic printing device with yellow toner, cyan toner and black toner and wherein the magenta toner, yellow toner, cyan toner, and black toner indicate viscosity values which vary over the temperature range of 100° C. at 50 rad/second to 150° C. at 50 rad/second wherein the viscosity values of the magenta toner are within plus or minus 1.0 poise to plus or minus 5000 poise of the viscosity values for the yellow, cyan and black toner. In addition, the magenta toner may indicate a Shimadzu $T_1$ temperature value of 110° C. to 118° C. and a Shimadzu $T_4$ temperature value of 120° C. to 125° C.

In addition, the present invention relates to a method for forming a magenta toner with a desired viscosity versus temperature profile which comprises providing a toner containing polymer resin binder, wherein the magenta toner powder so obtained may be characterized as having L*=41.07 (sd=0.424), a*=57.84 (sd=0.54) and b*=0.58 (sd=0.26) when measured on a mixture of magenta powder and 0.2% silica. The polymer resin binder contains at least three polymers having number average molecular weight (Mn) values of: (a) Mn=15,000 to 25,000; (b) Mn=400,000 to 600,000; and (c) Mn=950,000-1,500,000. One may then adjust the concentration of the resins having the above indicated Mn values to provide a desired temperature versus viscosity behavior for the toner over a temperature range between 100° C. at 50 rad/second to 150° C. at 50 rad/second.

BRIEF DESCRIPTION OF THE DRAWINGS

The above-mentioned and other features and advantages of this disclosure, and the manner of attaining them, will become more apparent and the disclosure will be better understood by reference to the following description of embodiments taken in conjunction with the accompanying drawings, wherein.

DETAILED DESCRIPTION

Figure 1:
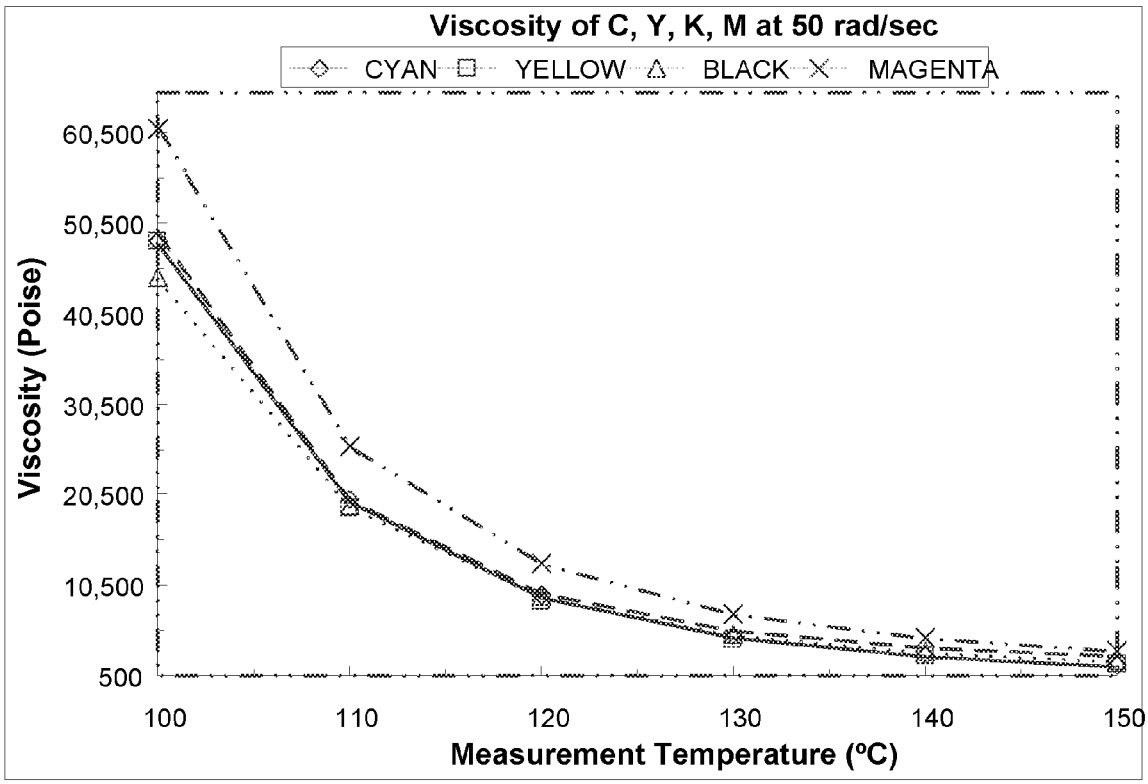
FIG. 1 is a graph of viscosity vs. temperature for toner colors C, M, Y and K using a common base resin blend.

FIG. 1 is a graph of viscosity in poise vs. measurement temperature in degrees Celsius using an Advanced Rheological Expansion System (ARES) Model M at a shear rate of 50 rad./sec. for the four toner colors, cyan, magenta, yellow and black, used in a printer cartridge. The lines for yellow (Y) and cyan (C) toner colors basically overlie each other between 100° C. and 150° C. with a viscosity of about 49,000 poise measured at 100° C. The line for black (K) toner basically overlies the lines for yellow and cyan between 110° C. and 150° C. with a slightly lower viscosity measured at 100° C., about 45000 poise. Magenta toner (M) appears to have a relatively higher viscosity at all temperatures measured with a viscosity of about 60,500 poise at 100° C. This difference in viscosity for magenta is believed to contribute to relatively poorer fusing properties. Note that the shear rate of 50 rad./sec. is relatively higher than what may exist in a belt fuser nip, and that lower shear rates, and lower temperatures, may further magnify the differences in viscosity.

For the purpose of the present disclosure, reference to magenta may be understood as having L*=41.07 (sd=0.424), a*=57.84 (sd=0.54) and b*=0.58 (sd=0.26) when measured on a mixture of magenta powder and 0.2% silica (A-R812, a product of De Gussa Corporation) using the Konica Minolta Chroma Color CR 300. The term "sd" refers to standard deviation. The CPT powder and silica may be vigorously mixed together, as in a Cyclomix blender, until a homogenous powder is obtained. The powder is then added to the Minolta CR-A50 granular materials attachment (used for the measurement of finely divided powders) until the inside slot is full. The cover is attached, the sample tapped three times to remove any entrapped air, and the color may then be characterized with the Konica Minolta Chroma Color CR 300.

Base formulations for four exemplary toner colors are next shown in Table 1:

TABLE 1

| Color | % Wax | % CCA | % Pigment | % Resin |
|---|---|---|---|---|
| Cyan (C) | 6.0 | 3.75 | 4.37 | 85.88 |
| Magenta (M) | 6.0 | 3.75 | 6.8 | 83.45 |
| Yellow (Y) | 6.0 | 3.75 | 6.0 | 84.25 |
| Black (K) | 6.0 | 3.75 | 8.0 | 82.25 |

The pigments used for each color were (C) Pigment Blue 15:3; (M) a blend of Pigment Red 122 and Pigment Red 184; (Y) Pigment Yellow 74 and (K) Carbon Black 7. An examination of the weight percent resin in each of the above cyan, magenta, yellow and black toners demonstrate that the amount of resin may differ by +/− about 3.0% for all four toners. However, the resin composition may be the same for all of the colors in the sense of utilizing a styrene-acrylate copolymer structure. This copolymer resin is typically the combination of a majority percent (e.g. ≧80.0%) of a relatively low MW resin, and a minority percent (e.g. ≦10.0% of a relatively medium MW resin) and a minority percent (e.g. ≦10.0%) of a relatively high MW resin. See Table 2:

TABLE 2

| Polymer Latex | % By Weight | Molecular Weight (g/mol) [Mn] |
|---|---|---|
| Neocryl A3000 | 80 | Low, 15,000-25,000 |
| Neocryl A3025 | 10 | Medium, 400,000-600,000 |
| Neocryl A3050 | 10 | High, 950,000-1,500,000 |

As can be seen, each latex resin (A3000, A3025 and A3050) is the same styrene/acrylate copolymer, but of differing number average (Mn) molecular weight. As such, there is a relatively small difference in glass transition temperature latex to latex and from one latex mixture to another (e.g. a Tg difference of +/−5° C.). This may be an advantage, given that glass transition may be manipulated in order to improve the fusing response, but frequently degrades the filming response. The balance of properties in the toner may then be achieved by employing a glass transition temperature which meets filming and ship/store requirements. The fusing response may now be modified by modification of the latex ratios. For example, to improve the fusing response, additional low molecular weight latex might now be employed, as discussed more fully herein.

It should also be clear from Table 1 that the black toner contains the lowest relative amount of resin, while the cyan toner contains the highest relative amount of resin. A toner composed solely of resin may be considered to be the fusing baseline or benchmark. As the resin is usually the dominating factor which controls toner fusibility, it may be assumed that the toner with the most resin (the least filled with a mixture of polymer-soluble and/or insoluble additive species) may be the most fusible. Likewise, that color with the highest relative amount of filler (or the least resin such as the black toner) might be the most difficult to fuse.

Each latex resin may have an influence on toner performance and toner fusing, the extent of influence directly related to the balance between the amount of latex in the resin mixture and the other constituents. Therefore, the performance of the toners of Table 1 may also now be determined by the pigment type and level, since the toners may be similar in other respects.

The fusing of toner may be determined by the fusing conditions (temperature and pressure) along with the imagery used to make the determination as well as the specific order in which the colors are deposited. The order of color layering may be the result of a number of considerations: yellow may be the first color to be placed on the final substrate (to avoid color contamination problems readily visible in that color). The cyan and black colors may be deposited in any order, that is, C-K or K-C. Magenta may be the top most color.

It has been recognized herein that relatively large changes in the glass transition temperature of the toner such (as +/−5.0° C.) will influence fusing, but in the case of the latex resins in Table 1 (where co-monomer ratios were constant) latex resin ratio changes were not be expected to greatly affect the glass transition temperature. This was due to the fact that changes in Mn or even MW distribution (weight average molecular weight divided by number average molecular weight or Mw/Mn) over a minimum value of Mn (e.g. at or over about 15,000) were recognized herein as not generally leading to a relatively large Tg change (i.e. less than +/−5° C.). Furthermore, the relatively largest effect on fusing was now identified to be reflected by observing changes in the polymer melt temperature, $T_1$ and $T_4$, which are a Shimadzu-derived standard of measure, relating a polymer's propensity to flow at a given temperature but varying shear rates.

Modifications to the 80/10/10 ratio of resins in Table 1 were next explored using a Shimadzu CFT-500A/B viscosity and flow testing instrument under the premise that the $T_1$ and $T_4$ temperature values may be readily manipulated by movement of the latex ratio away from that shown in Table 1. More specifically, $T_1$ and $T_4$ refer to 1 mm and 4 mm offsets, respectively, from a flow test curve with a constant heating method (piston stroke vs. temperature) for a toner, wherein the offset value is from $S_{min}$, or the non-flow region between the softening temperature $T_s$ and the flow beginning temperature $T_{fb}$. Reference is made to "Shimadzu Flowtester CFT-500D/100D Capillary Rheometers" for a summary description of the Shimadzu viscosity testing protocols and variables that may be measured utilizing such procedure.

Table 3 lists the melt/flow temperatures, $T_1$ and $T_4$, for various ratios of latex resin, each pigmented magenta. The sample at the top of Table 3 represents the control value of 80% resin Neocryl A3000, 10% resin Neocryl A3025 and 10% resin Neocryl A3050, where the resin Mn values were noted above.

TABLE 3

| A3000 | A3025 | A3050 | $T_1/T_4$, ° C. |
|---|---|---|---|
| 80 | 10 | 10 | 120.5/127.3 |
| 90 | 10 | 0 | 111.3/118.8 |
| 90 | 0 | 10 | 112.2/120.0 |
| 90 | 5 | 5 | 110.8/118.4 |
| 80 | 20 | 0 | 115.1/123/8 |
| 80 | 0 | 20 | 118.9/128.5 |

Values of $T_1$ lower than 120.5° C. were believed to have potential for improving the fusing ability of magenta toner. Because magenta's apparent viscosity was relatively higher than that of the other colors (FIG. 1) a change in the above ratios of latex resins was evaluated to attempt to modify the viscosity of the magenta toner so that the resulting magenta toner viscosity essentially matched that of the other colors. Because the ratios of latex resins in Table 3 provided some rather significant changes in $T_1$ and $T_4$ temperatures, a more modest modification in latex ratios was evaluated, which would then permit the magenta viscosity data to fall more in line with that of the other colors and there provide relatively low effects on toner processing parameters (i.e., toner manufacturing). Table 4 lists the latex ratios used to develop a family of magenta toners at a 50 liter scale (toner 165-3 was the 80/10/10 control):

TABLE 4

| Toner ID | A3000 | A3025 | A3050 | $T_1/T_4$, ° C. |
|---|---|---|---|---|
| 165-3 | 80 | 10 | 10 | 117.4/126.1 |
| 165-4 | 83 | 8.5 | 8.5 | 115.9/124/2 |
| 165-5 | 85 | 10 | 5 | 114.5/122.6 |
| 165-6 | 85 | 5 | 10 | 116.7/124.5 |
| 165-7 | 87 | 6.5 | 6.5 | 113.9/122.2 |

Figure 2:
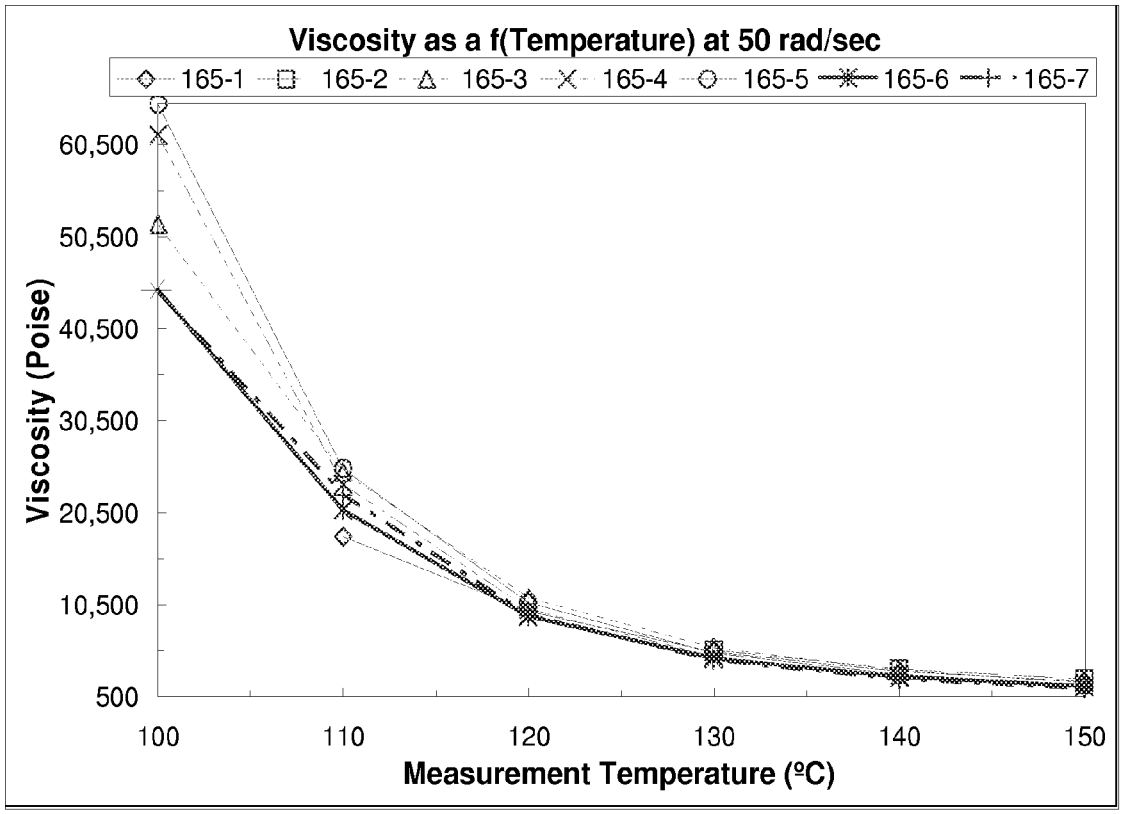
FIG. 2 is a graph of viscosity vs. temperature for toner color M where the resin blend has been modified to vary the viscosity curve for toner color M.

FIG. 2 is a graph of viscosity as a function of measurement temperature for the magenta toners in Table 4. The viscosity of these toners embraced a relatively wide range at 100° C., and several of the trials (notably toners 165-6 and 165-7) displayed a relatively lower viscosity than the control toner (165-3). Again, the control toner contains what it noted above in Table 1 for magenta. Differential scanning calorimetry (DSC) data were relatively similar for all of these toners. Toners 165-6 and 165-7 were scaled up further and 165-6 was found to exhibit improved fusibility, that is, a fuse temperature that was 5° C. less than the control (165-3). Table 5 illustrates these results:

TABLE 5

| Toner | Heater Temperature (° C.) | | | | | | | | |
|---|---|---|---|---|---|---|---|---|---|
| ID | 150 | 155 | 160 | 165 | 170 | 175 | 180 | 185 | 190 |
| 165-3 | insf | insf | insf | fused | fused | fused | fused | fused | fused |
| 165-4 | insf | insf | insf | insf | insf | fused | fused | fused | fused |
| 165-5 | insf | insf | insf | insf | fused | fused | fused | fused | fused |
| 165-6 | insf | insf | fused | fused | fused | fused | fused | fused | fused |
| 165-7 | insf | insf | insf | fused | fused | fused | fused | fused | fused |

Note that "insf" indicates insufficient fusing.

Figure 3:
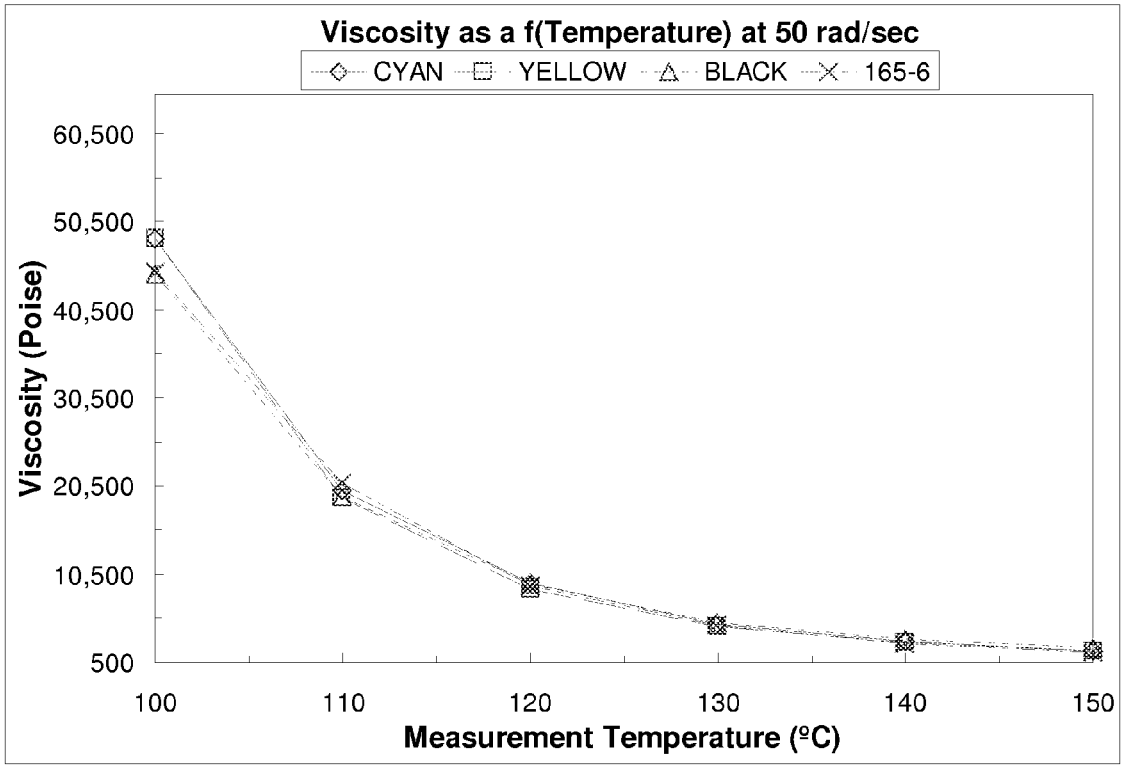
FIG. 3 is a graph of viscosity vs. temperature for toner colors C, M, Y and K where the resin blend has been modified for toner color M (165-6) to approximate the viscosity of the other colors.

Viscosity as a function of measurement temperature was again determined using ARES. The results are shown in FIG. 3. Note that the viscosity curve for the magenta toner (165-6) much more closely approximates the curves for the other three colors (Y, C, K) and the viscosity at 100° C. is essentially equal to that of the black toner (K). More specifically, the magenta toner herein may be provided with a viscosity versus temperature behavior such that the magenta toner is within +/−5000 poise of the yellow toner (Y), cyan toner (C) and black toner (K) over the temperature range of 100° C. to 150° C. measured at 50 rad/second. Furthermore, such magenta toner viscosity may be within relatively closer proximity to the viscosity of the other colored toners, such as within +/−1.0 to 5000 poise, including all values therein, in 1.0 poise increments. Accordingly, the magenta toner herein may now be within, e.g., 10, 100, 1000, 2000,3000, 4000 and up to 5000 poise of any of the other colored toners that may be utilized.

Accordingly, it can be seen that the magenta toner has now been prepared by adjusting the relative compositions of Mn values across at least three (3) samples of resin having differing Mn values. Furthermore, it can be seen that such magenta toner with a viscosity of less than or equal to 50,000 poise at 100° C. at 50 rad/sec may be configured herein to provide a non-linear drop to a value of less than or equal to 1000 poise at 150° C. at 50 rad/sec. Furthermore, such non-linear drop is one that coincides with the observed non-linear drop of the other colored toners, wherein at 110° C., 120° C., 130° C., 140° C. and 150° C., the magenta toner has a viscosity that is within less than or equal to +/−500 poise of the Y, C and K toners, in 1.0 poise increments. For example, at such indicated temperatures, the magenta toner may be within +/−400 poise, +/−300 poise, +/−200 poise, +/−100 poise, or +/−50 poise, etc.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A magenta toner for developing electrostatic images comprising:

a binder resin including:

85.0-87.0% of a polymer resin having a Mn value of 15,000 to 25,000;

5.0-6.5% of a polymer resin having a Mn value of 400,000 to 600,000; and 6.5-10.0% of a polymer resin having a Mn value of 950,000-1,500,000; and a colorant;

wherein the magenta toner when mixed with 0.2% silica provides a powder characterized as having L*=41.07±0.424, a*=57.84±0.54 and b*=0.58±0.26.

2. The magenta toner of claim 1 wherein said toner has a viscosity of less than or equal to 50,000 poise measured at 100° C. at 50 rad/second.

3. The magenta toner of claim 1 wherein said toner has a viscosity of less than or equal to 50,000 poise measured at 100° C. at 50 rad/second and a viscosity of less than or equal to 1000 poise measured at 150° C. at 50 rad/second.

4. The magenta toner of claim 1 wherein said colorant includes a mixture of two or more colorants.

5. The magenta toner of claim 1 wherein the binder resins comprise a polymer resin containing styrene and acrylate co-monomers.

6. The magenta toner of claim 1 wherein said colorant includes Pigment Red 122 and Pigment Red 184.

7. A magenta toner for developing electrostatic images comprising:

a binder resin including:

85.0-87.0% of a polymer resin having a Mn value of 15,000 to 25,000;

5.0-6.5% of a polymer resin having a Mn value of 400,000 to 600,000; and 6.5-10.0% of a polymer resin having a Mn value of 950,000 -1,500,000; and a colorant;

wherein the magenta toner when combined with 0.2% silica provides a powder characterized as having L*=41.07±0.424, a*=57.84±0.54 and b*=0.58±0.26; and wherein said magenta toner has a Shimadzu T1 temperature value of 110° C. to 118° C. and a Shimadzu T4 temperature value of 120° C. to 125° C.

8. A method for forming a magenta toner with a desired viscosity versus temperature profile, comprising:

providing a polymer resin binder, containing at least three polymers having number average molecular weight (Mn) values of:

Mn=15,000 to 25,000;

Mn=400,000 to 600,000; and

Mn=950,000-1,500,000; and adjusting the concentration of the polymer resins having said Mn values to provide the magenta toner having viscosity of less than or equal to 50,000 poise measured at 100° C. at 50 rad/second and a viscosity of less than or equal to 1000 poise measured at 15020 C. at 50 rad/second;

wherein the formed magenta toner when mixed with 0.2% silica provides a powder characterized as having L*=41.07±0.424, a*=57.84±0.54 and b*=0.58±0.26.

9. The method of claim 8 wherein the concentration of polymer resins having said Mn values is adjusted to:

85.0-87.0% for a polymer resin having a Mn value of 15,000 to 25,000;

5.0-6.5% for a polymer resin having a Mn value of 400,000 to 600,000; and 6.5-10.0% for a polymer resin having a Mn value of 950,000-1,500,000.

10. The method of claim 8, wherein said magenta toner has a Shimadzu T1 temperature value of 110° C. to 118° C. and a Shimadzu T4 temperature value of 120° C. to 125° C.

11. A magenta toner composition for developing electrostatic images comprising:

a magenta toner including a binder resin and a colorant, wherein the binder resin includes:

85.0-87.0% of a polymer resin having a Mn value of 15,000 to 25,000;

5.0-6.5% of a polymer resin having a Mn value of 400,000 to 600,000; and 6.5-10.0% of a polymer resin having a Mn value of 950,000-1,500,000; and 0.2% silica;

wherein the magenta toner composition is characterized as having L*=41.07±0.424, a*=57.84±0.54 and b*=0.58±0.26.

* * * * *